US011761183B2

(12) United States Patent
Mesarina

(10) Patent No.: US 11,761,183 B2
(45) Date of Patent: Sep. 19, 2023

(54) SOAP DISPENSER SHOWER HEAD APPARATUS

(71) Applicant: Jose Mesarina, Cicero, IL (US)

(72) Inventor: Jose Mesarina, Cicero, IL (US)

( * ) Notice: Subject to any disclaimer, the term of this patent is extended or adjusted under 35 U.S.C. 154(b) by 252 days.

(21) Appl. No.: 17/323,455

(22) Filed: May 18, 2021

(65) Prior Publication Data

US 2022/0372737 A1 Nov. 24, 2022

(51) Int. Cl.

| | |
|---|---|
| ***E03C 1/04*** | (2006.01) |
| ***E03C 1/046*** | (2006.01) |
| ***B05B 7/24*** | (2006.01) |
| ***B05B 1/18*** | (2006.01) |

(52) U.S. Cl.

CPC ..... *E03C 1/046* (2013.01); *B05B 1/18* (2013.01); *B05B 7/24* (2013.01)

(58) Field of Classification Search

CPC .. E03C 1/046; B05B 1/18; B05B 7/24; B05B 1/16; B05B 1/185

See application file for complete search history.

(56) References Cited

U.S. PATENT DOCUMENTS

| | | | | |
|---|---|---|---|---|
| 3,367,580 | A | 2/1968 | Hronas | |
| 4,607,793 | A | 8/1986 | Eberle | |
| D326,896 | S | 6/1992 | McNeely | |
| 5,562,248 | A | 10/1996 | Khalifka | |
| 6,550,695 | B1 * | 4/2003 | Trent | E03C 1/046 239/419 |
| 6,687,924 | B2 | 2/2004 | Wright | |
| 8,800,891 | B2 | 8/2014 | Cheng | |
| 2009/0101733 | A1 * | 4/2009 | Popov | B05B 1/1636 4/615 |
| 2009/0224071 | A1 | 9/2009 | Yogashwer | |
| 2012/0091231 | A1 * | 4/2012 | Ajagbe | A61L 9/05 239/418 |

FOREIGN PATENT DOCUMENTS

| | | |
|---|---|---|
| WO | WO2019055239 | 3/2019 |

* cited by examiner

*Primary Examiner* — Qingzhang Zhou

(57) ABSTRACT

A soap dispenser shower head apparatus for dispensing cleaning products directly through the shower head includes a head body including a body sidewall with a compartment aperture and a switch slot extending through to a body interior. A body top side engages a shower pipe. A compartment is coupled to the head body within the body interior and extends to the body sidewall on each side of the compartment aperture to define a compartment interior. The compartment interior receives a water soluble bath product pod through the compartment aperture. A valve is coupled within the body interior and moves between a rinse position and a lather position to selectively cover or expose the compartment interior, respectively. A switch is coupled to the valve and extends through the switch slot to move the valve between the rinse position and the lather position.

7 Claims, 6 Drawing Sheets

SOAP DISPENSER SHOWER HEAD APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to shower head devices and more particularly pertains to a new shower head device for dispensing cleaning products directly through the shower head. The present device includes a compartment to receive a water soluble product pod.

A switch closes a compartment door and opens a valve within the shower head to selectively mix the bath product from the product pod into the water.

(2) Description of Related Art Including Information Disclosed Under 37 CFR 1.97 and 1.98

The prior art relates to shower head devices. Known devices include external reservoirs to hold liquid bath product and selectively mix them into water flowing through the shower head. These devices require bulky reservoirs and cannot receive single-use water soluble pods.

BRIEF SUMMARY OF THE INVENTION

An embodiment of the disclosure meets the needs presented above by generally comprising a head body including a body sidewall, a body top side, and a body bottom side defining a body interior. The body sidewall has a compartment aperture extending through to the body interior and a switch slot extending through to the body interior below the compartment aperture. The body bottom side has a plurality of spray apertures extending through to the body interior. The body top side is configured to engage a shower pipe. A compartment is coupled to the head body within the body interior and extends to the body sidewall on each side of the compartment aperture to define a compartment interior. The compartment interior receives a water soluble bath product pod through the compartment aperture. A valve is coupled to the head body. The valve is coupled within the body interior and moves between a rinse position and a lather position to selectively cover or expose the compartment interior, respectively. A switch is coupled to the valve. The switch extends through the switch slot of the body sidewall to move the valve between the rinse position and the lather position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
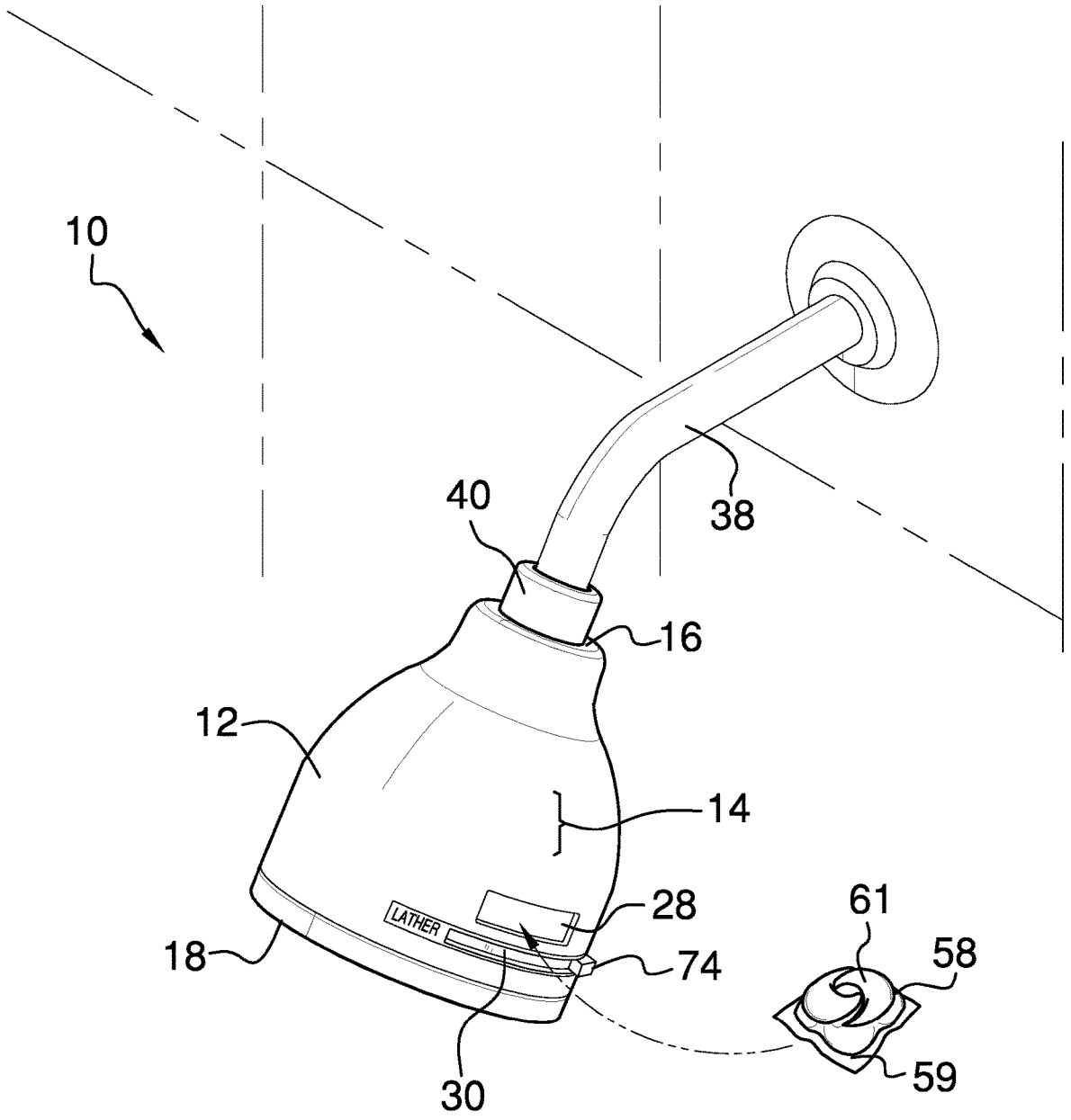
FIG. 1 is an isometric view of a soap dispenser shower head apparatus according to an embodiment of the disclosure.
Figure 2:
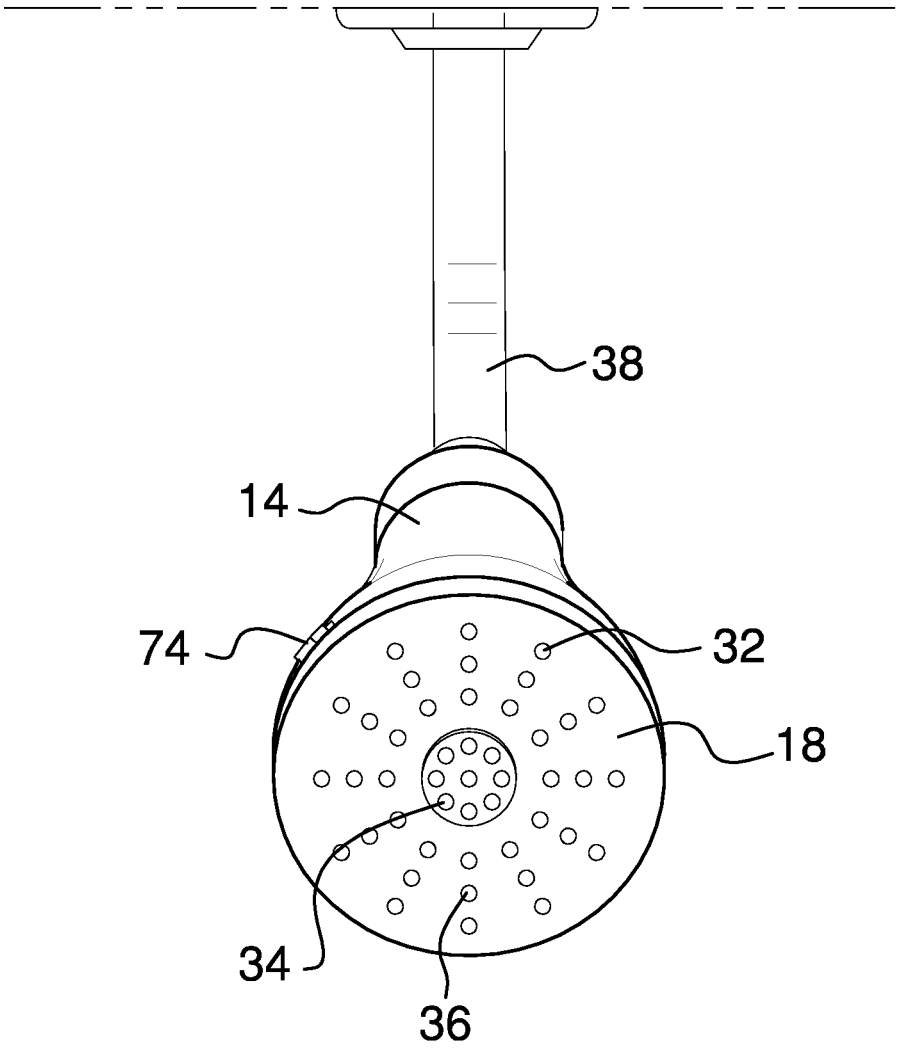
FIG. 2 is an isometric view of an embodiment of the disclosure.
Figure 3:
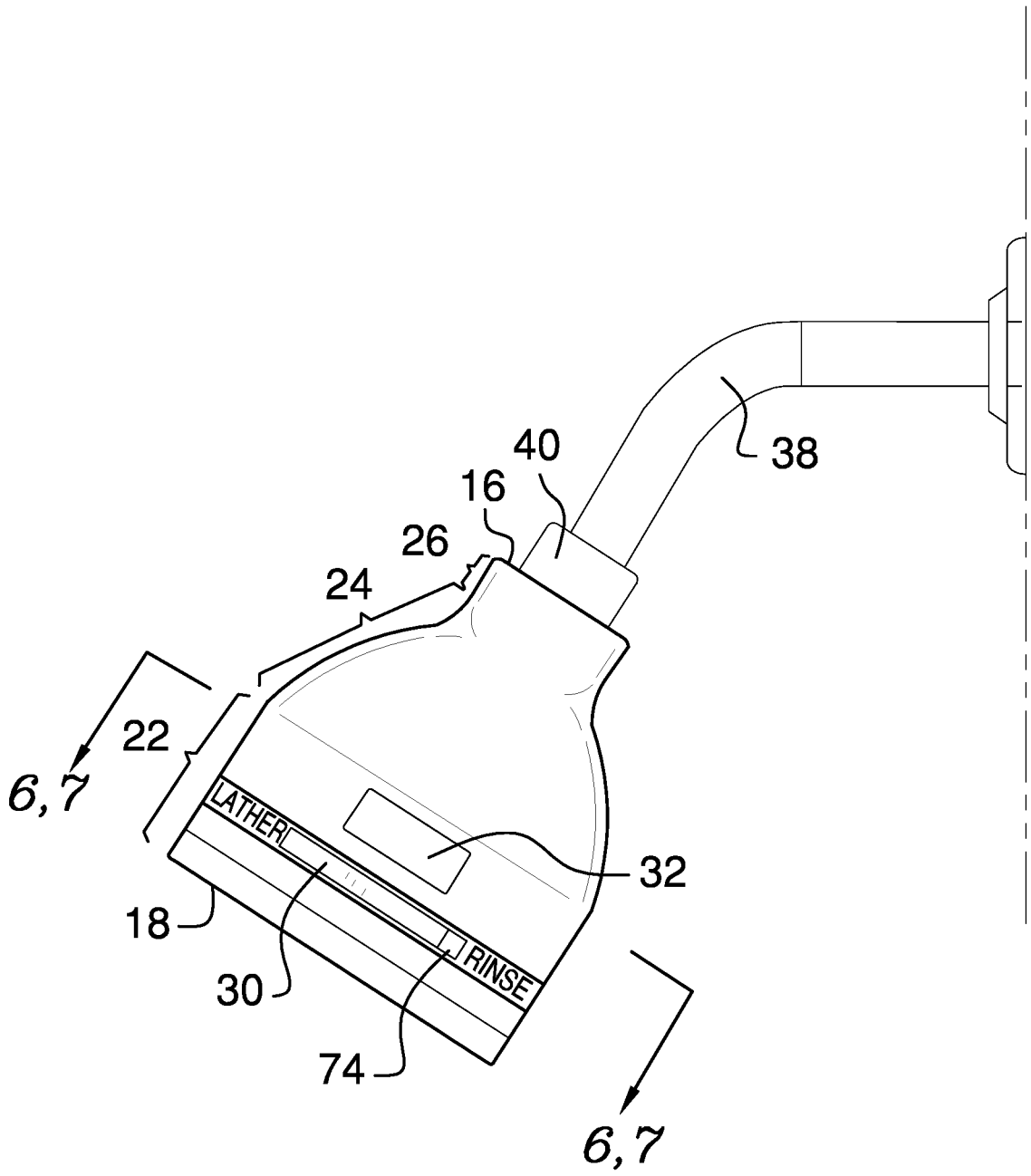
FIG. 3 is a side elevation view of an embodiment of the disclosure.
Figure 4:
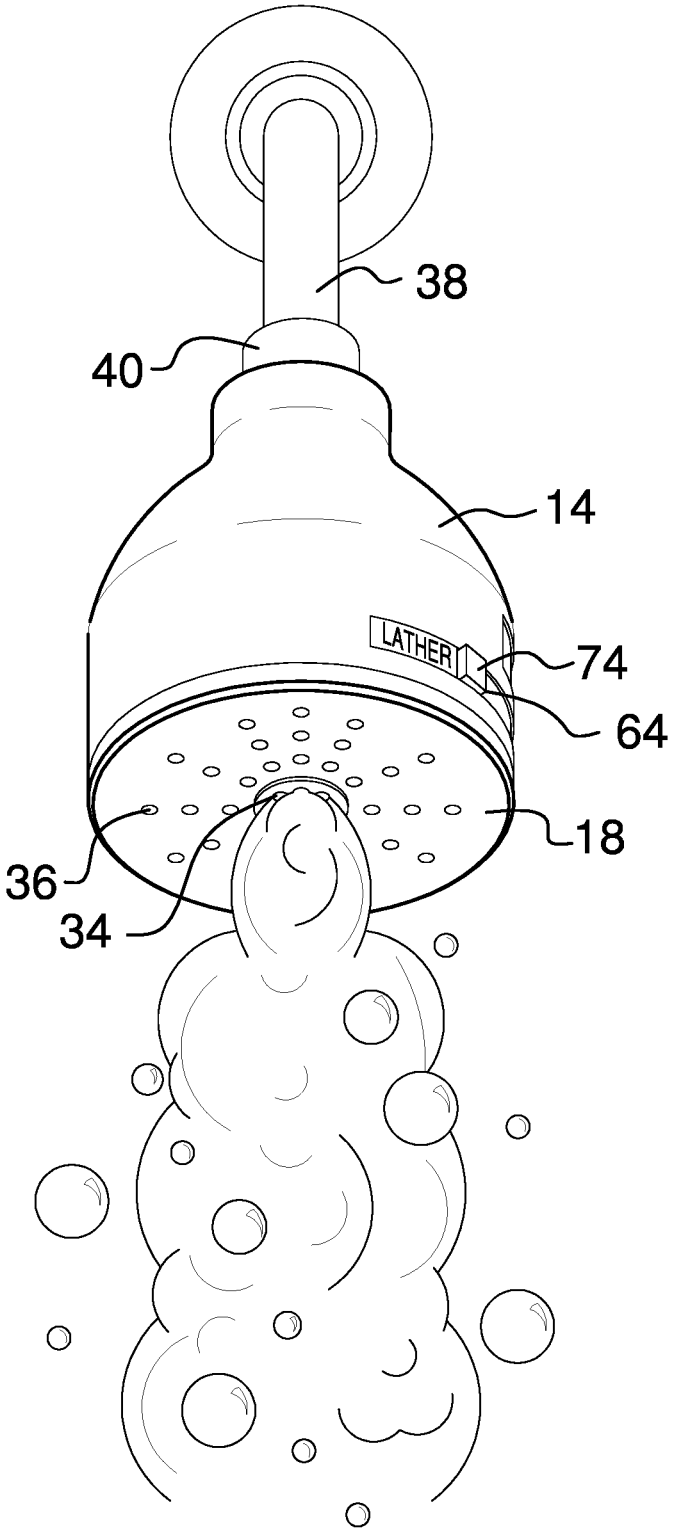
FIG. 4 is an isometric in-use view of an embodiment of the disclosure.
Figure 5:
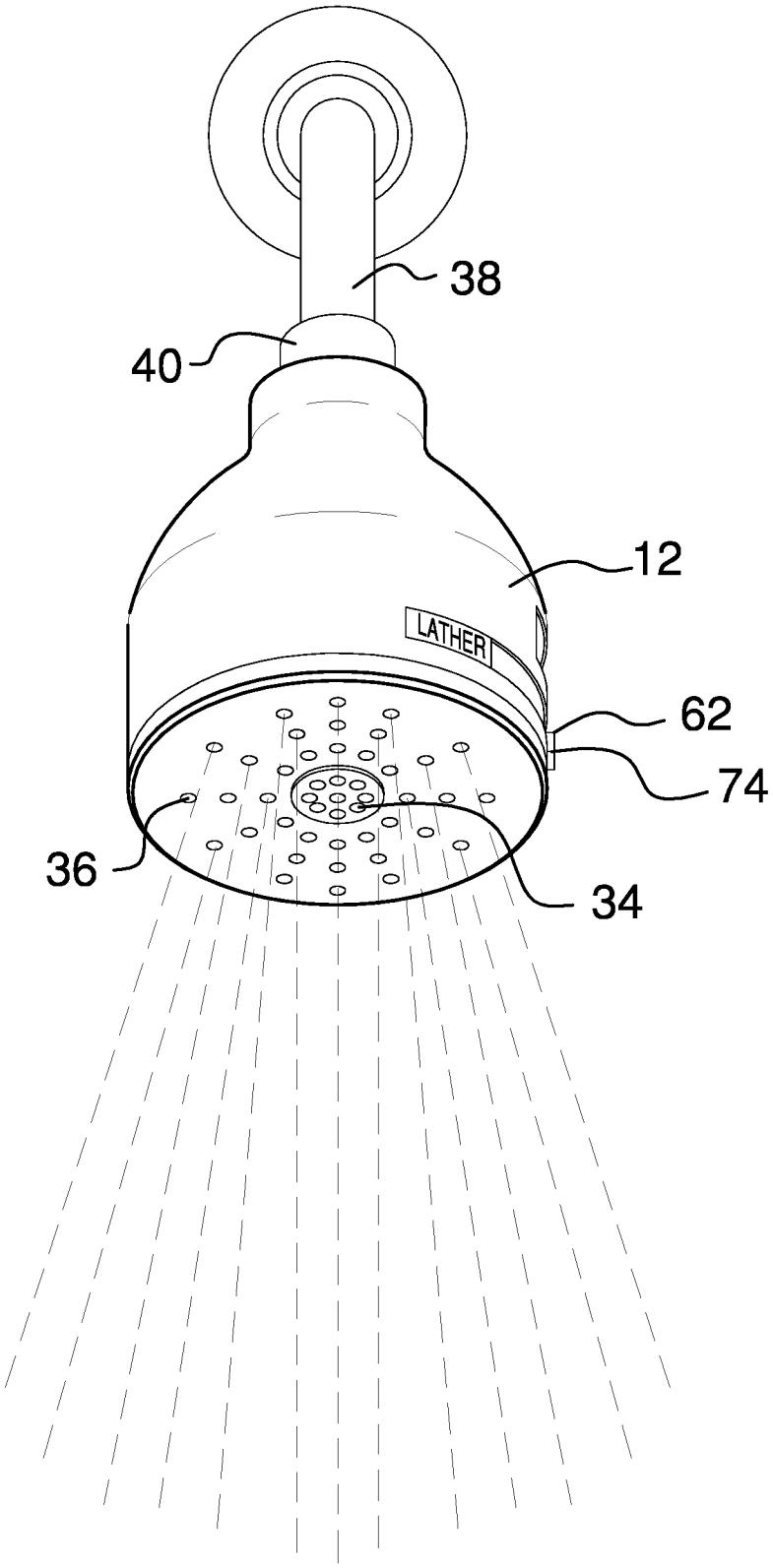
FIG. 5 is an isometric in-use view of an embodiment of the disclosure.
Figure 6:
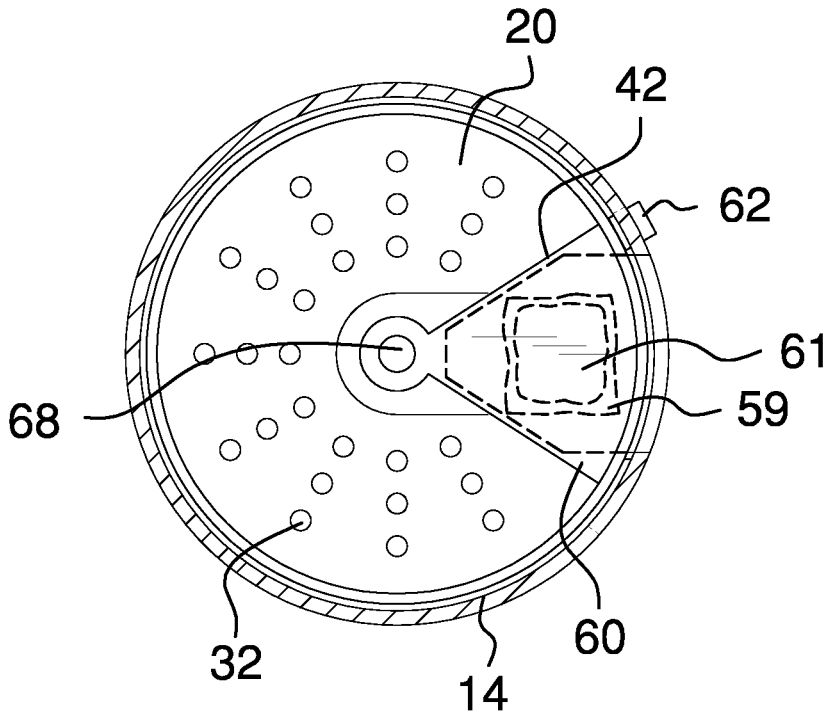
FIG. 6 is a cross-sectional view of an embodiment of the disclosure along the line 6-6 of FIG. 3.
Figure 7:
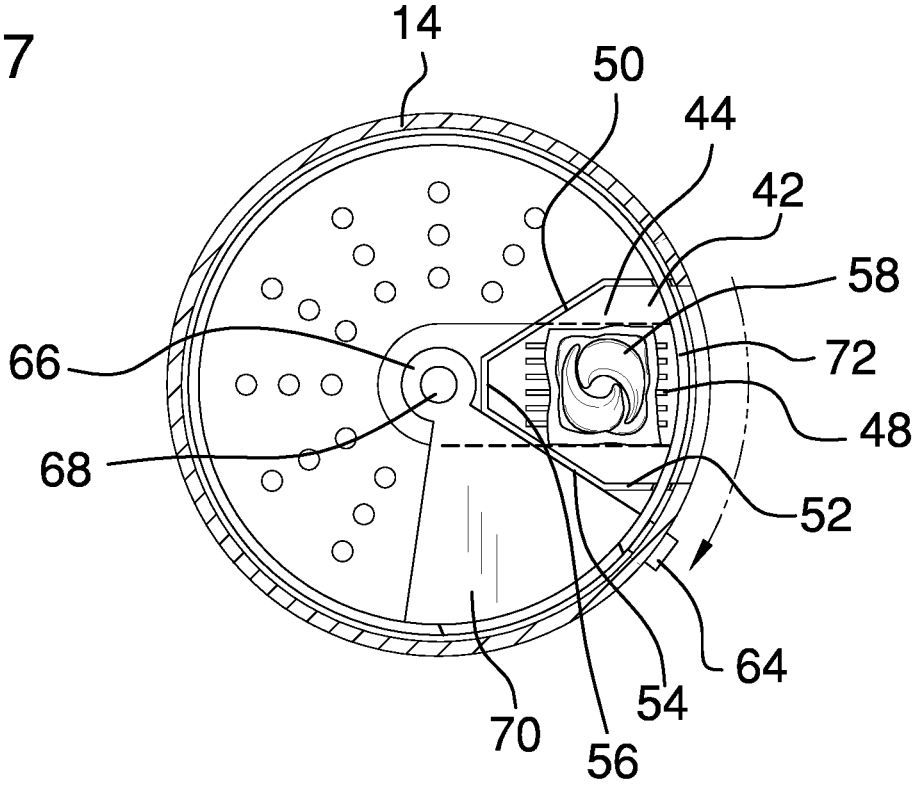
FIG. 7 is a cross-sectional view of an embodiment of the disclosure along the line 7-7 of FIG. 3.

With reference now to the drawings, and in particular to FIGS. 1 through 7 thereof, a new shower head device embodying the principles and concepts of an embodiment of the disclosure and generally designated by the reference numeral 10 will be described.

As best illustrated in FIGS. 1 through 7, the soap dispenser shower head apparatus 10 generally comprises a head body 12 including a body sidewall 14, a body top side 16, and a body bottom side 18 defining a body interior 20. The body sidewall 14 may have a cylindrical portion 22 adjacent the body bottom side 18, a curved portion 24 extending from the cylindrical portion 22, and a collar portion 26 adjacent the body top side 16.

The body sidewall 14 has a compartment aperture 28 extending through the cylindrical portion 22 to the body interior 20 and a switch slot 30 extending through to the body interior 20 below the compartment aperture 28. The compartment aperture 28 may be rectangular. The body bottom side 18 has a plurality of spray apertures 32 extending through to the body interior 20. The plurality of spray apertures 32 may include a plurality of central apertures 34 and a plurality of radial apertures 36 extending from the plurality of central apertures 34. The body top side 16 is configured to engage a shower pipe 38 and may include an attachment collar 40.

A compartment 42 is coupled to the head body 12. The compartment 42 is coupled within the body interior 20 and extends to the body sidewall 14 on each side of the compartment aperture 28 to define a compartment interior 44. The compartment 42 includes a compartment bottom 46 having a plurality of compartment slots 48 extending through to the body interior 20 and a plurality of compartment walls 50 extending from the body sidewall 14 around the compartment bottom 46. The plurality of compartment walls 50 includes a pair of parallel portions 52 extending from the body sidewall 14, a pair of angled portions 54 tapering in from the parallel portions 52, and a perpendicular end portion 56 connecting the pair of angled portions 54 and lying perpendicular to the pair of parallel portions 52.

The compartment interior 44 receives a water soluble bath product pod 58 through the compartment aperture 28. The water soluble bath product pod 58 includes a water soluble outer skin 59 covering a bath product 61 such as body wash, shampoo, conditioner, or a three-in-one combining all three. When the water soluble bath product pod 58 is placed under water the outer skin 59 dissolves allowing the bath product 61 to mix with the water flowing through the head body 12.

A valve 60 is coupled to the head body 12. The valve 60 is coupled within the body interior 20 and moves between a rinse position 62 (shown in FIGS. 5 and 6) and a lather position 64 (shown in FIGS. 4 and 7) to selectively cover or expose the compartment interior 44, respectively. The valve 60 may have an annular pivot portion 66 rotatably coupled around a pivot 68, a wedge top portion 70 to selectively cover and expose the compartment interior 44, and a curved door portion 72 matching the curvature of the body sidewall 14 to selectively cover and expose the compartment aperture 28. The valve 60 may direct water flow through the plurality of central apertures 34 in the lather position 64 and through the plurality of radial apertures 36 in the rinse position 62. A switch 74 is coupled to the valve 60. The switch 74 extends through the switch slot 30 of the body sidewall to move the valve 60 between the rinse position 62 and the lather position 64.

In use, the apparatus 10 may be used as a traditional showerhead while in the rinse position 62. The water soluble bath product pod 58 is then placed into the compartment interior 44 through the compartment aperture 28 and the valve 60 is moved to the lather position 64. The curved door portion 72 seals the compartment aperture 28 and the wedge top portion 70 moves to expose the compartment interior 44, allowing the water soluble bath product pod 58 to dissolve and mix with the water coming through the plurality of spray apertures 32. When done lathering, the valve 60 is returned to the rinse position 62 for pure water to come out.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A soap dispenser shower head apparatus comprising:

a head body including a body sidewall, a body top side, and a body bottom side defining a body interior, the body sidewall having a compartment aperture extending through to the body interior and a switch slot extending through to the body interior below the compartment aperture, the body bottom side having a plurality of spray apertures extending through to the body interior, the body top side being configured to engage a shower pipe;

a compartment coupled to the head body, the compartment being coupled within the body interior and extending to the body sidewall on each side of the compartment aperture to define a compartment interior, the compartment interior receiving a water soluble bath product pod through the compartment aperture, the compartment including a compartment bottom having a plurality of compartment slots extending through to the body interior and a plurality of compartment walls extending from the body sidewall around the compartment bottom, the plurality of compartment walls including a pair of parallel portions extending from the body sidewall, a pair of angled portions tapering in from the parallel portions, and a perpendicular end portion connecting the pair of angled portions and lying perpendicular to the pair of parallel portions;

a valve coupled to the head body, the valve being coupled within the body interior and moving between a rinse position and a lather position to selectively cover or expose the compartment interior, respectively; and a switch coupled to the valve, the switch extending through the switch slot of the body sidewall to move the valve between the rinse position and the lather position.

2. The soap dispenser shower head apparatus of claim 1 further comprising the valve having an annular pivot portion rotatably coupled around a pivot, a wedge top portion to selectively cover and expose the compartment interior, and a curved door portion matching the curvature of the body sidewall to selectively cover and expose the compartment aperture.

3. The soap dispenser shower head apparatus of claim 1 further comprising the body sidewall having a cylindrical portion adjacent the body bottom side, a curved portion extending from the cylindrical portion, and a collar portion adjacent the body top side.

4. The soap dispenser shower head apparatus of claim 3 further comprising the compartment aperture extending through the cylindrical portion.

5. The soap dispenser shower head apparatus of claim 1 further comprising the plurality of spray apertures including a plurality of central apertures and a plurality of radial apertures extending from the plurality of central apertures.

6. The soap dispenser shower head apparatus of claim 5 further comprising the valve directing water flow through the plurality of central apertures in the lather position and through the plurality of radial apertures in the rinse position.

7. A soap dispenser shower head apparatus comprising:

a head body including a body sidewall, a body top side, and a body bottom side defining a body interior, the body sidewall having a cylindrical portion adjacent the body bottom side, a curved portion extending from the cylindrical portion, and a collar portion adjacent the body top side, the body sidewall having a compartment aperture extending through the cylindrical portion to the body interior and a switch slot extending through to the body interior below the compartment aperture, the body bottom side having a plurality of spray apertures extending through to the body interior, the plurality of spray apertures including a plurality of central apertures and a plurality of radial apertures extending from the plurality of central apertures, the body top side being configured to engage a shower pipe;

a compartment coupled to the head body, the compartment being coupled within the body interior and extending to the body sidewall on each side of the compartment aperture to define a compartment interior, the compartment including a compartment bottom having a plurality of compartment slots extending through to the body interior and a plurality of compartment walls extending from the body sidewall around the compartment bottom, the plurality of compartment walls including a pair of parallel portions extending from the body sidewall, a pair of angled portions tapering in from the parallel portions, and a perpendicular end portion connecting the pair of angled portions and lying perpendicular to the pair of parallel portions, the compartment interior receiving a water soluble bath product pod through the compartment aperture;

a valve coupled to the head body, the valve being coupled within the body interior and moving between a rinse position and a lather position to selectively cover or expose the compartment interior, respectively, the valve having an annular pivot portion rotatably coupled around a pivot, a wedge top portion to selectively cover and expose the compartment interior, and a curved door portion matching the curvature of the body sidewall to selectively cover and expose the compartment aperture, the valve directing water flow through the plurality of central apertures in the lather position and through the plurality of radial apertures in the rinse position; and a switch coupled to the valve, the switch extending through the switch slot of the body sidewall to move the valve between the rinse position and the lather position.

* * * * *